US012385726B2

(12) United States Patent
Cragg

(10) Patent No.: US 12,385,726 B2
(45) Date of Patent: Aug. 12, 2025

(54) MULTI-PURPOSE POUCH

(71) Applicant: James Cragg, Carson, CA (US)

(72) Inventor: James Cragg, Carson, CA (US)

( * ) Notice: Subject to any disclaimer, the term of this patent is extended or adjusted under 35 U.S.C. 154(b) by 165 days.

(21) Appl. No.: 18/375,939

(22) Filed: Oct. 2, 2023

(65) Prior Publication Data

US 2024/0110772 A1 Apr. 4, 2024

Related U.S. Application Data

(60) Provisional application No. 63/412,358, filed on Sep. 30, 2022.

(51) Int. Cl.
*F42B 39/02* (2006.01)
*A45F 5/02* (2006.01)

(52) U.S. Cl.
CPC ..... *F42B 39/02* (2013.01); *A45F 5/02* (2013.01)

(58) Field of Classification Search
CPC .... A45F 5/00; A45F 5/02; A45F 5/021; F42B 39/02
USPC ..... 224/196, 236, 237, 250, 931
See application file for complete search history.

(56) References Cited

U.S. PATENT DOCUMENTS

D437,111 S * 2/2001 Bergh ..... D3/218
6,364,187 B1 * 4/2002 Castellano ..... A45F 5/02 224/675
6,662,986 B2 * 12/2003 Lehtonen ..... A45F 5/02 224/675
6,926,182 B2 * 8/2005 Cragg ..... F41C 33/0218 224/236
7,458,491 B2 * 12/2008 Cragg ..... A45F 3/14 224/648
7,597,225 B2 * 10/2009 Badillo ..... H04B 1/385 224/675
7,780,048 B2 * 8/2010 Howell ..... F42B 39/02 224/931
7,918,371 B2 * 4/2011 Wilson ..... F41A 9/65 224/931
8,240,532 B2 * 8/2012 Cragg ..... F42B 39/02 224/648
D697,711 S * 1/2014 Stevens, IV ..... D3/221
9,394,080 B2 * 7/2016 Beck ..... A45C 13/30
9,427,069 B1 * 8/2016 Carver ..... A45F 5/00
D772,368 S * 11/2016 Evans ..... D22/108
9,668,568 B2 * 6/2017 Evans ..... A45F 5/02
9,759,536 B2 * 9/2017 Gadams ..... B65D 63/10
(Continued)

*Primary Examiner* — Justin M Larson
(74) *Attorney, Agent, or Firm* — Camuti Law Group, APC; Nathan Camuti

(57) ABSTRACT

There is disclosed a multi-purpose pouch comprising a pouch base, a pouch body having a first side, a second side opposite the first side, and a front, and a pouch back opposite the front, the pouch base and pouch body forming a pouch pocket, wherein a top portion of the pouch body and the pouch back define an aperture for receiving an object to be stored in the pouch pocket, a closure flap extending from a top end of the pouch back, and wherein the closure flap may optionally be stowed along a pouch side of the pouch back when the multi-purpose pouch is in an operational configuration, and a looped retention element having an initial end and a terminal end, the looped retention element forming a loop beginning and ending at a retention element clasp, and looping around the multi-purpose pouch in an figure-eight pattern.

7 Claims, 6 Drawing Sheets

(56) References Cited

U.S. PATENT DOCUMENTS

| | | | | |
|---|---|---|---|---|
| 9,795,210 | B2 * | 10/2017 | Evans | F42B 39/02 |
| 9,861,184 | B2 * | 1/2018 | VanHeusen | F41C 33/0209 |
| 10,352,652 | B2 * | 7/2019 | Higdon, Jr. | F41C 33/0236 |
| 10,571,220 | B2 * | 2/2020 | Toschi | F41C 33/04 |
| 10,928,172 | B1 * | 2/2021 | Mironski | F42B 39/02 |
| 11,033,095 | B1 * | 6/2021 | VanHeusen | A45F 5/00 |
| D955,740 | S * | 6/2022 | Velenchenko | D3/218 |
| 11,506,473 | B2 * | 11/2022 | Beck | A45C 13/30 |
| 11,533,984 | B2 * | 12/2022 | Duncan | A45C 3/001 |
| D996,808 | S * | 8/2023 | Celiktras | D3/218 |
| 11,835,327 | B2 * | 12/2023 | Smith | F42B 39/02 |
| D1,012,490 | S * | 1/2024 | Grant | D3/221 |
| 11,953,301 | B2 * | 4/2024 | Isaacson | F42B 39/02 |
| 12,098,909 | B2 * | 9/2024 | Chambers | F42B 39/02 |
| 12,247,815 | B2 * | 3/2025 | Smith | F42B 39/02 |
| 2023/0258440 | A1 * | 8/2023 | Chambers | F42B 39/26 206/3 |
| 2023/0284773 | A1 * | 9/2023 | Popp | B65D 33/16 |
| 2024/0110772 | A1 * | 4/2024 | Cragg | F42B 39/02 |
| 2025/0085092 | A1 * | 3/2025 | Kramer | F42B 39/02 |

* cited by examiner

MULTI-PURPOSE POUCH

BACKGROUND

Presently, a magazine holder or pouch generally features a flap over the top of a pouch, and item(s) are placed into the pouch and the flap covers the item(s) and pouch opening. The flap may provide protection and secure the item in the pouch when one is crawling, rappelling, jumping out of a vehicle, and doing other rigorous activities. In order to access items placed in the pouch, one must first grab the edge of the flap to open the pouch and make sure the flap is not in the way as one reaches into the pouch to grab the desired item. Opening the flap to access the item may be cumbersome and take extra time. However, during times of minimal or less rigorous activity, it may be convenient to leave the flap open for easy access to the contents of the pouch. However, objects may fall or tumble out of the pouch when the flap is left open or unsecured. There is a need to secure the items even with the flap open while still allowing for easy access to the items. Accordingly, there is a need for a system for a multi-purpose magazine holder that address the above noted problems and also provides additional features.

In some embodiments, the multi-purpose pouch comprises a pouch base, a pouch body having a first side, a second side opposite the first side, and a front, and a pouch back opposite the front, the pouch base and pouch body forming a pouch pocket, wherein a top portion of the pouch body and the pouch back define an aperture for receiving an object to be stored in the pouch pocket, wherein the pouch body includes a fastener element, a closure flap extending from a top end of the pouch back, the closure flap comprising the complementary fastener element for engaging the fastener element when the multi-purpose pouch is in a closed configuration, and wherein the closure flap may optionally be stowed along a pouch side of the pouch back when the multi-purpose pouch is in an operational configuration, and a looped retention element having an initial end and a terminal end, the looped retention element forming a loop beginning at a retention element clasp, extending around a first side of the multi-purpose pouch and around the front of the multi-purpose pouch, through a front retention element guide, looping around a second side of the multi-purpose pouch, passing through a rear retention element guide positioned at a midpoint of the top end of the pouch side of the pouch back, continuing around the first side of the multi-purpose pouch passing through the front retention element guide in the opposite direction, continuing around the second side of the multi-purpose pouch, and passing through the retention element clasp, wherein the retention element clasp engages the initial and terminal ends of the looped retention element, wherein the retention element clasp is operable to allow a user to adjust a tension of the looped retention element by adjusting the length of the looped retention element.

In some embodiments, the multi-purpose pouch comprises a first securing tab and a second securing tab configured to engage the first securing tab to secure an object in the pouch pocket, the first securing tab engaged with a first securing section of the looped retention element extending between the front retention element guide and a first side of the rear retention element guide and a second securing tab engaged with a second securing section of the looped retention element extending between a second side of the rear retention element guide and the front retention element guide, the securing tabs configured to allow the user to engage the first securing tab with the second securing tab such that the looped retention element passes over an object in the pouch pocket as the looped securing element extents between the front retention element guide and the rear retention element guide.

In some embodiments, the securing tabs are engaged using a securing tab engagement interface.

In some embodiments, the securing tab engagement interface is hook-and-loop interface.

In some embodiments, the multi-purpose pouch comprises a first side sleeve on the first side of the multi-purpose pouch and a second side sleeve on the second side of the multi-purpose pouch, the side sleeves for stowing the securing tabs.

In some embodiments, the multi-purpose pouch comprises a clasp mount positioned proximate to the rear retention element guide, wherein the clasp mount secures the retention element clasp.

In some embodiments, the front retention element guide is a piece of webbing attached to the front of the pouch pocket creating a passage for the looping retention element and the rear retention element guide is a tube formed by a webbing attached to a top of the back of the multi-purpose pouch.

DETAILED DESCRIPTION

Figure 1:
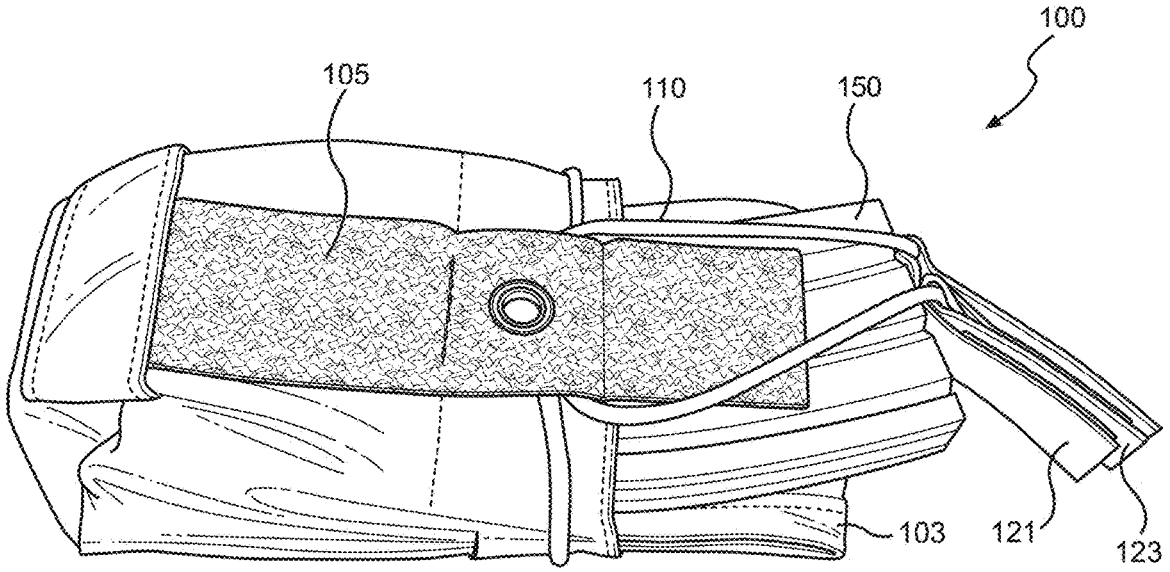
FIG. 1 shows a front view of a multi-purpose pouch, according to one embodiment of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale and are not intended to correspond to actual relative dimensions.

FIG. 1 shows a front view of a multi-purpose pouch, according to one embodiment of the present disclosure. The terms pouch 100 and holder are interchangeably used terms throughout this disclosure. In the depicted embodiment, multi-purpose pouch 100 comprises flap 103, fastener element 105, and retention element 110. In the depicted embodiment, object 150 is inserted into a large pocket of pouch 100. As depicted, object 150 is an ammunition magazine. In some embodiments, object 150 may be any item that can fit into pouch 100. In some embodiments, object 150 may be a hand grenade, a medical kit, a parachute cartridge, an ammunition magazine, a walkie-talkie, a handheld transceiver, a radio, or any item(s) that can fit into pouch 100.

In the depicted embodiment, fastener element 105 on is on the front surface of pouch 100. In some embodiments, fastener element 105 may be one side of a hook and loop fastener, a snap button, a magnetic closure, a hook and eye closure, a button closure, and other types of complementary fasteners or closures. In some embodiments, the complementary side to fastener element 105 is located in the underside of flap 103 that is not pictured as flap 103 is tucked into the large pocket of pouch 100. In some embodiments, flap 103 extends out and covers object 150 and the underside of flap 103 has a complementary fastener element (not pictured) that fastens to 105 fastener element 105. In the depicted embodiment, the complementary fastener element (not pictured) on the underside of flap 103 is a hook and loop fastener that complementarily fastens to the hook and loop fastener of fastener element 105. In some embodiments, complementary fastener element (not pictured) may be a complementary side of a hook and loop fastener, a snap button, a magnetic closure, a hook and eye closure, a button closure, and other types of complementary fasteners or closures.

In the depicted embodiment, flap 103 is tucked into the large pocket of pouch 100. With flap 103 tucked into the large pocket of pouch 100, object 150 is exposed for easier access without taking the extra steps of opening flap 103 and then feeling around to access object 150. In the depicted embodiment, object 150 is exposed and retained in pouch 100 with retention element 110 extending over a top of object 150. In the depicted embodiment, retention element 110 is an elastic cord that is routed and/or threaded around pouch 100 forming multiple configurations. In one configuration of retention element 110 shown in the depicted embodiment, the retention element 110 is configured to extend over a top of object 150 to retain object 150 inside pouch 100 such that object 150 does not fall out. In some embodiments, retention element 110 extends over the top of object 150 that protrudes from pouch 100 and restrains object 150 from falling out of pouch 100 such that movement of object 100 pushes against retention element 110 which retains object 100 within pouch. In the depicted embodiment, to remove object 150 from pouch 100, retention element 110 has different configurations. A first configuration entails shifting retention element 110 to the side so that object 150 no longer pushes or abuts against retention element 110 and object 150 can be lifted out of pouch 100.

In the depicted embodiment, retention element 110 comprises securing tabs 121, 123. In some embodiments, to shift retention element 110 to a side so that object 150 can be removed from pouch 100, the securing tabs 121, 123 can be grabbed or gripped and pulled from a top of object 150 and shifted to a side of object 150. As depicted, securing tabs 121, 123 are coupled together via hook and loop fasteners. In the depicted embodiment, securing tab 121 sandwiches securing tab 123.

Figure 2:
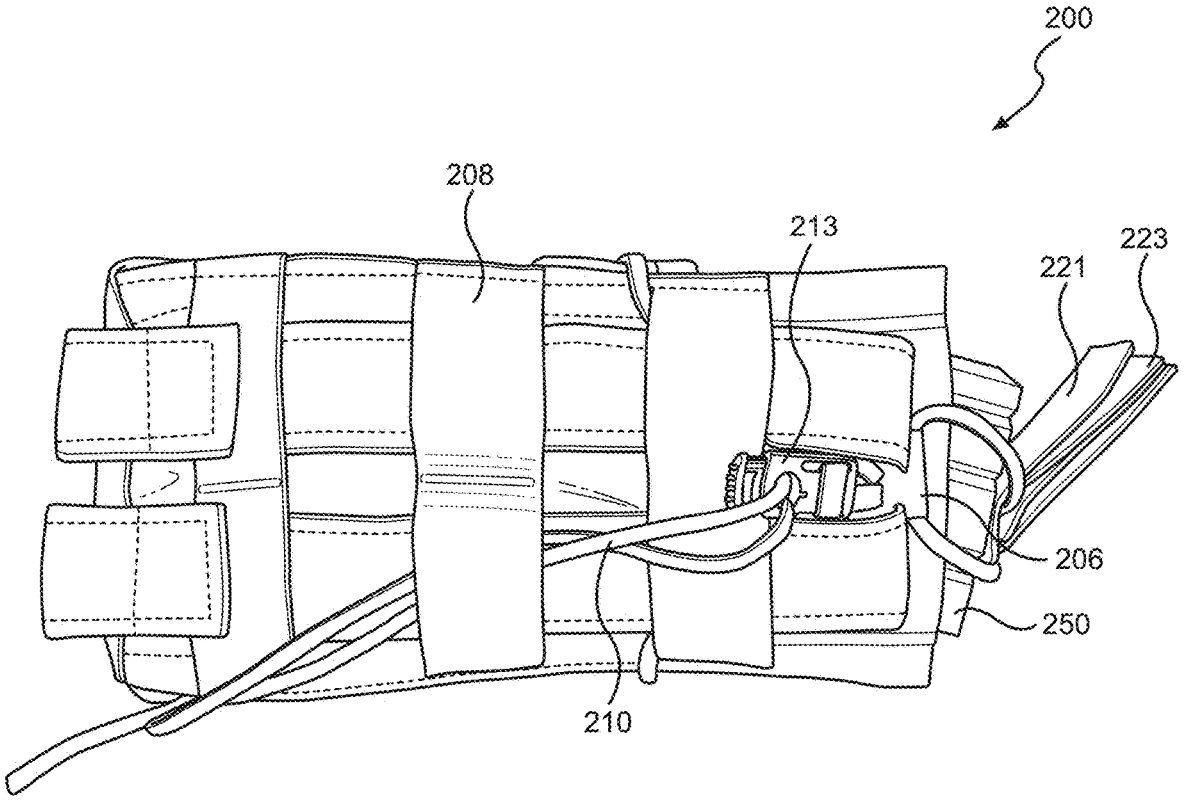
FIG. 2 shows a back view of a multi-purpose pouch, according to one embodiment of the present disclosure.

FIG. 2 shows a back view of a multi-purpose pouch, according to one embodiment of the present disclosure. In the depicted embodiment, multi-purpose pouch 100 comprises anchor element 206, guide straps 208, retention element 210, clasp 213, securing tabs 221, 223. In the depicted embodiment, retention element 210 is threaded through anchor element 206. Anchor element 206 may be a loop, a sleeve, a slot, or the like through which to thread retention element 210 to anchor, pin down, or attach the retention element 210 to pouch 200, wherein retention element 210 is split into two strands. In the depicted embodiment, the two strands of retention element 210 are routed in a double looping around pouch 200. As depicted, the two strands of retention element 210 are routed to the front of pouch 200 and threaded in opposite directions to crisscross through a guide strap or fastener element on the front of pouch 200 then wrapped around to the back of pouch 200 and tucked or threaded under guide strap 208 and the two strands meet and are fastened together. In some embodiments, the two strands are fastened together with a clasp, a fastener, a turtle cord lock, and the like. In some embodiments, the two strands are tied or knotted together. In the depicted embodiment, clasp 213 is a turtle cord lock through which the ends of the two cords are threaded and fastened or secured together.

In the depicted embodiment, clasp 213 can be adjusted to tighten retention element 210 or loosen retention element 210 so there is more slack. Tightening or loosening retention element 210 may help accommodate different sizes of object 250. The depicted embodiment shows an ammunition magazine, and there are a wide range of magazine sizes for different types of weapons. Tightening retention element 210 may tighten the waist of pouch 200. For example, tightening retention element 210 may secure a small-sized object 250, like a small parachute cartridge, by cinching a waist of pouch 200. In another example, loosening retention element 210 allows a large-sized object 250, like a walkie-talkie, to fit into pouch 200, and retention element 210 can extend over a the top of the large object 250. In some embodiments, the same pouch 200 can fit more than one ammunition magazine, a single magazine by tightening retention element 210 which in turn tightens waist of pouch 200, a smoke cannister, or other object 250.

Figure 3A:
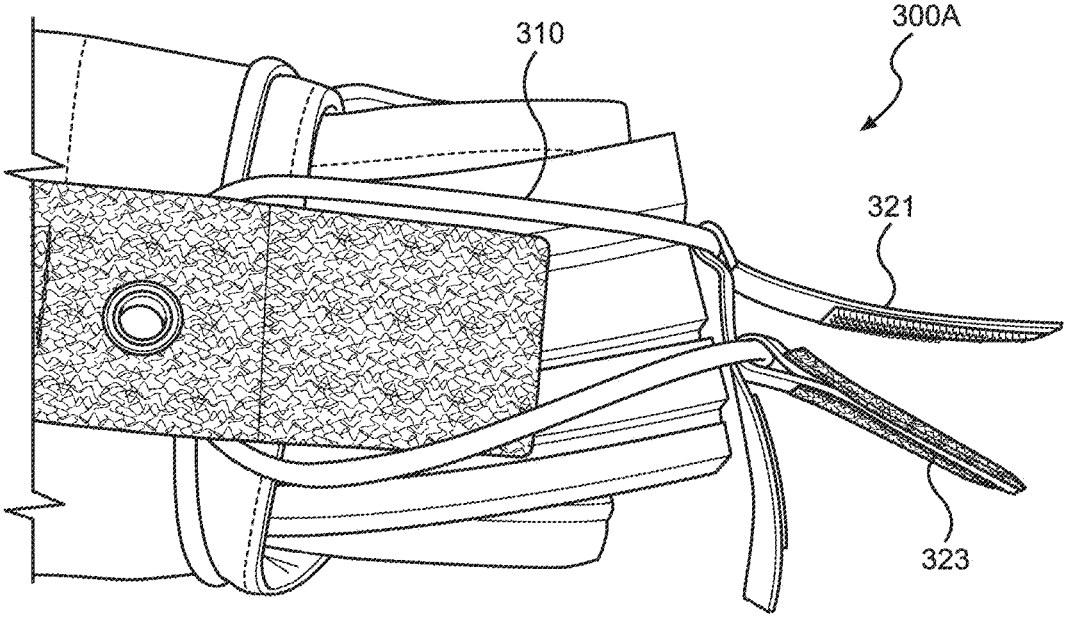
FIG. 3A shows a view of a multi-purpose pouch, according to one embodiment of the present disclosure.

FIG. 3A shows a view of a multi-purpose pouch, according to one embodiment of the present disclosure. As depicted, securing tabs 321, 323 with the hook and loop fasteners are separated. In some embodiments, one side of retention element 310 having securing tab 321 has a V-shape, wherein the bottom of the "V" is attached to one side of retention element 310. In the depicted embodiment, securing tab 321 has the hook side of hook and loop fasteners on the inner surface of the "V". In the depicted embodiment, the second side of retention element 310 having securing tab 323 is flat having the loop side of hook and loop fasteners on the outer surfaces of securing tab 323. In some embodiments, securing tab 321 may have the loop side of hook and loop fasteners on the inner surface of the "V", and securing tab 323 may have the hook side of hook and loop fasteners on its outer surfaces.

As depicted in FIG. 3A, securing tabs 321, 323 are attached together by inserting the second side of retention element 310 with securing tab 323 into the opening of securing tab 321 and closing the opening of the securing tab 321 such that securing tab 323 is sandwiched between the two sides of securing tab 321. The securing tabs 321, 323 attach to each other via the hook and loop fasteners. To separate securing tabs 321, 323 from each other, the two sides of securing tab 321 are split and pulled apart from securing tab 323 so that securing tabs 321, 323 are no longer attached.

Figure 3B:
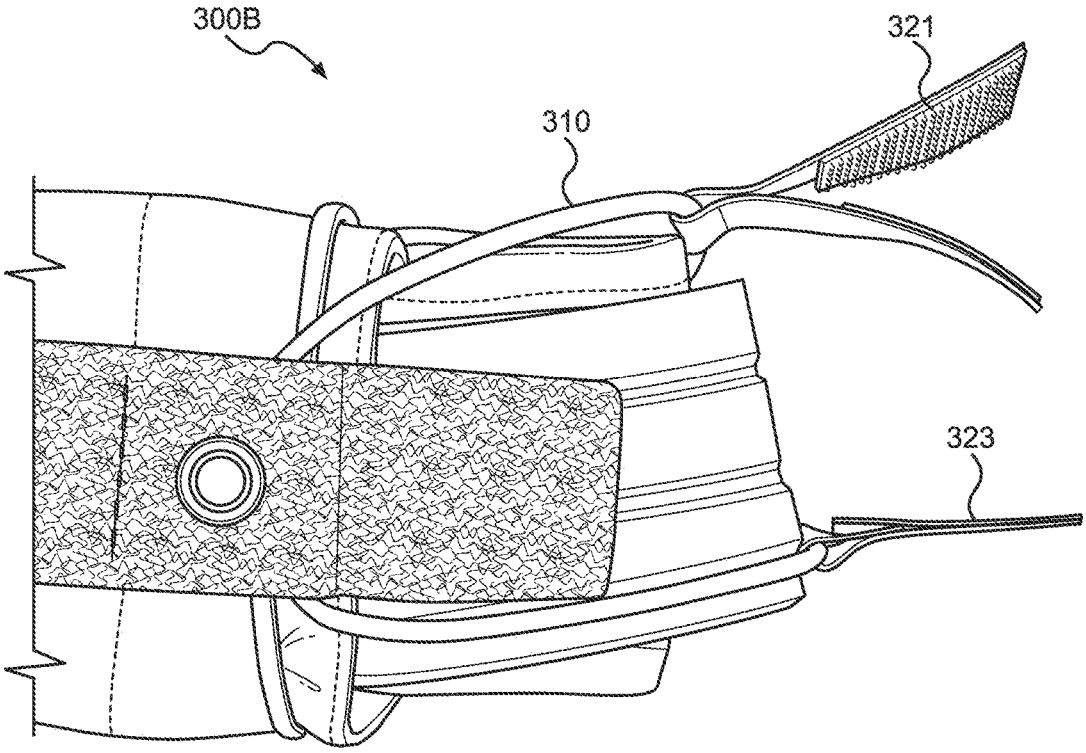
FIG. 3B shows another view of a multi-purpose pouch, according to one embodiment of the present disclosure.

FIG. 3B shows another view of a multi-purpose pouch, according to one embodiment of the present disclosure. As depicted in FIG. 3B, securing tabs 321, 323 are separated from each other. In some embodiments, securing tab 321 may sandwich securing tab 323 like a book or folder folds along the length of securing tab 323. In other embodiments, securing tab 321 is the depicted V-shape and sandwiches securing tab 323 as shown.

Figure 4:
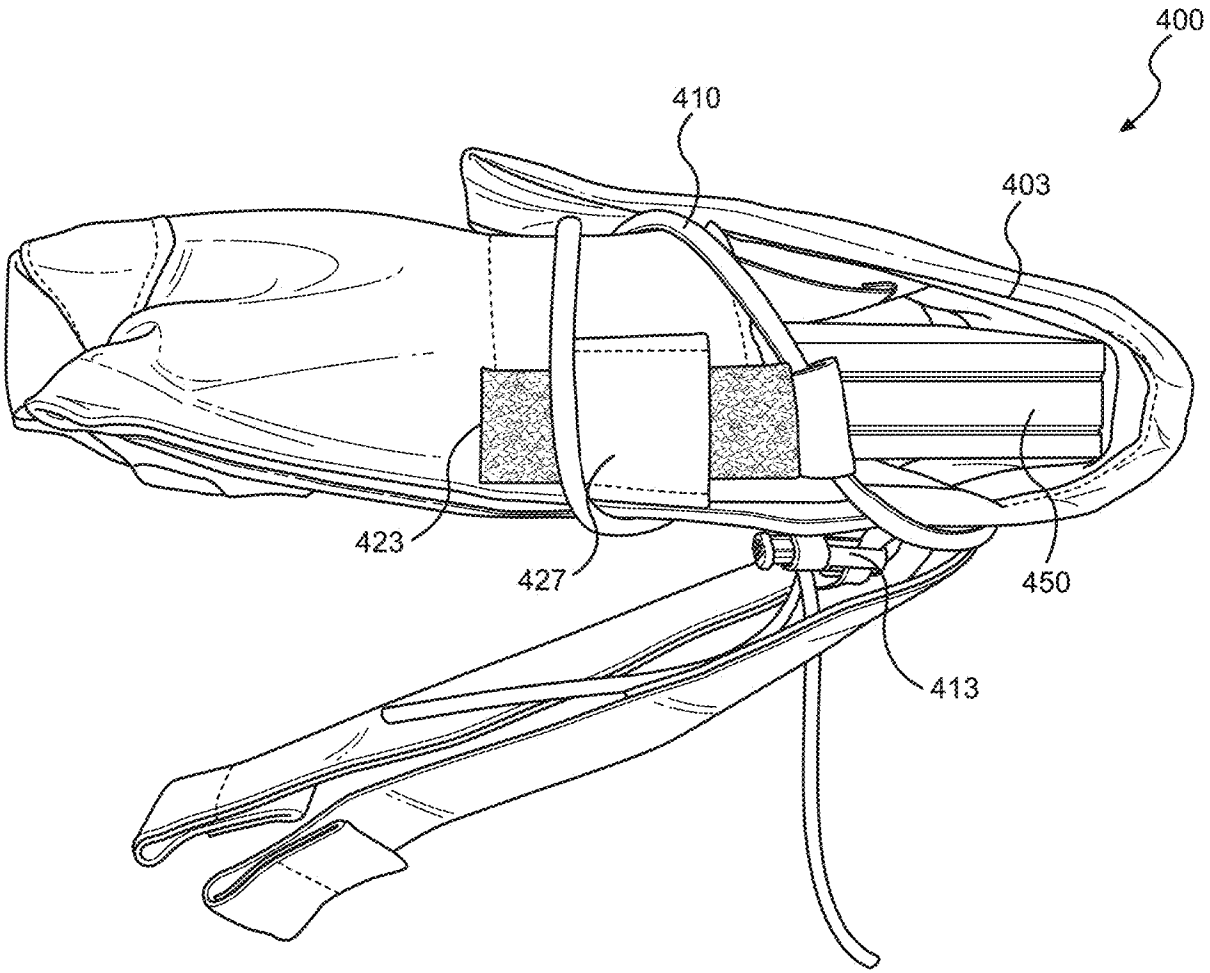
FIG. 4 shows a side view of a multi-purpose pouch, according to one embodiment of the present disclosure.

FIG. 4 shows a side view of a multi-purpose pouch, according to one embodiment of the present disclosure. In the depicted embodiment, flap 403 folds over covering object 450. As depicted, the underside of flap 403 attaches to fastener element (not clearly visible) on the front surface of pouch 400 via hook and loop fasteners. As depicted, retention element 410 is shifted to the side of pouch 400 and securing tab 423 is tucked into side sleeve 427. Tucking securing tab 423 into side sleeve 427 minimizes the amount of hanging materials from the strap and prevents or minimizes the likelihood of securing tab 423 getting caught on things. In the depicted embodiment, side sleeve 427 is open-ended such that securing tab 423 is visibly protruding beyond the bottom of side sleeve 427. In some embodiments, side sleeve 427 may be a pocket with a closed bottom so that securing tab 423 does not visibly protrude from beyond the bottom of side sleeve 427. As depicted side sleeve 427 is made of substantially the same material as pouch 400. In some embodiments, pouch 400 is made of a flexible material, including canvas, nylon, cotton, polyester, leather, rubber, or any combination thereof. In some embodiments, side sleeve 427 is made of a flexible material, including canvas, nylon, cotton, polyester, leather, rubber, or any combination thereof.

In some embodiments, side sleeve 427 may be made of a side fastener element that attaches or engages with securing tab 423. For example, the side fastener element may be the complementary side of a hook and loop fastener for securing tab 423 to engage with or attach to.

Figure 5:
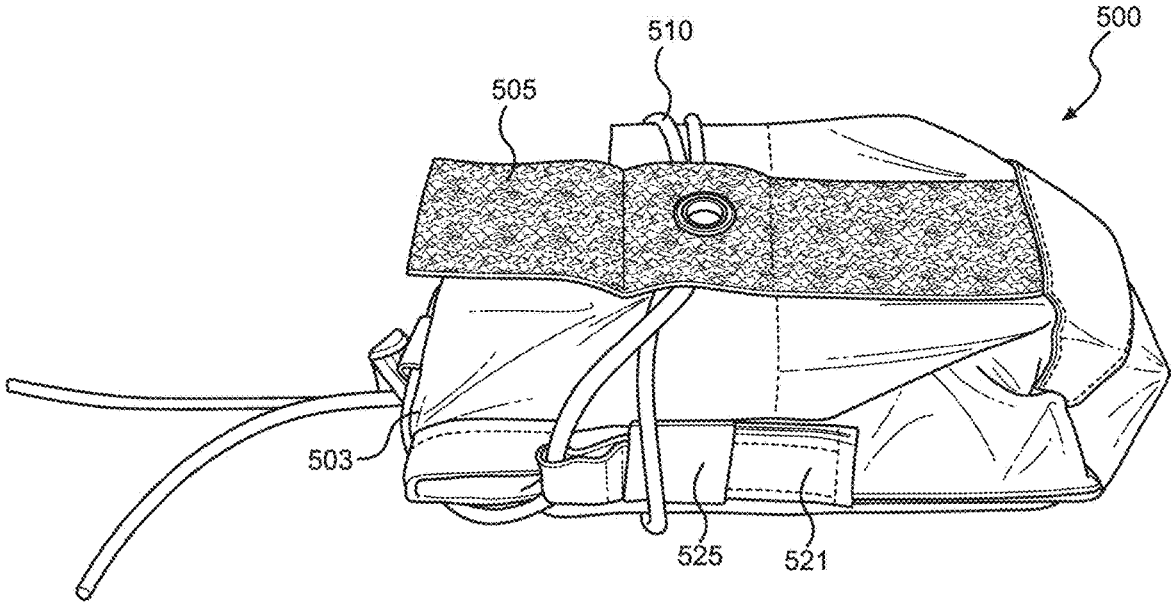
FIG. 5 shows a right-side perspective views of a multi-purpose pouch, according to one embodiment of the present disclosure.

FIG. 5 shows side perspective views of a multi-purpose pouch 500, according to one embodiment of the present disclosure. As depicted in the images, flap 503 is tucked into the large pocket of pouch 500. As depicted side sleeves 525, 527 are disposed on the left and right sides of pouch 500. As depicted, securing tab 521 is tucked into side sleeve 525, and securing tab 523 is tucked into side sleeve 527.

Figure 6:
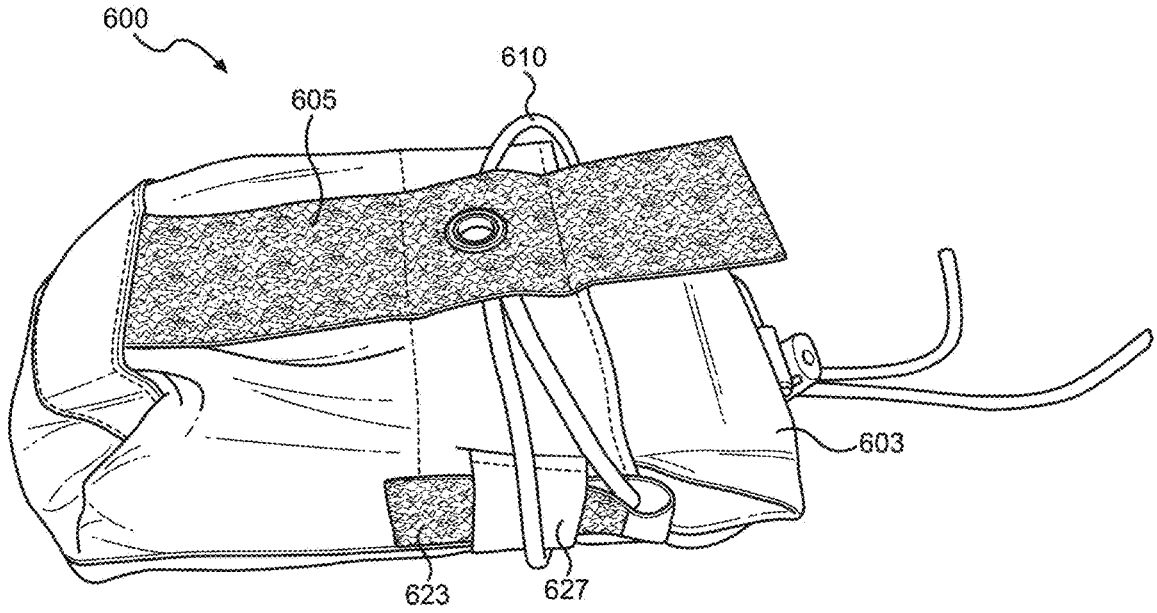
FIG. 6 shows a left-side perspective views of a multi-purpose pouch, according to one embodiment of the present disclosure.

FIG. 6 shows side perspective views of a multi-purpose pouch 600, according to one embodiment of the present disclosure. As depicted in the images, flap 603 is tucked into the large pocket of pouch 600. As depicted side sleeves 625, 627 are disposed on the left and right sides of pouch 600. As depicted, securing tab 621 is tucked into side sleeve 625, and securing tab 623 is tucked into side sleeve 627.

Figure 7:
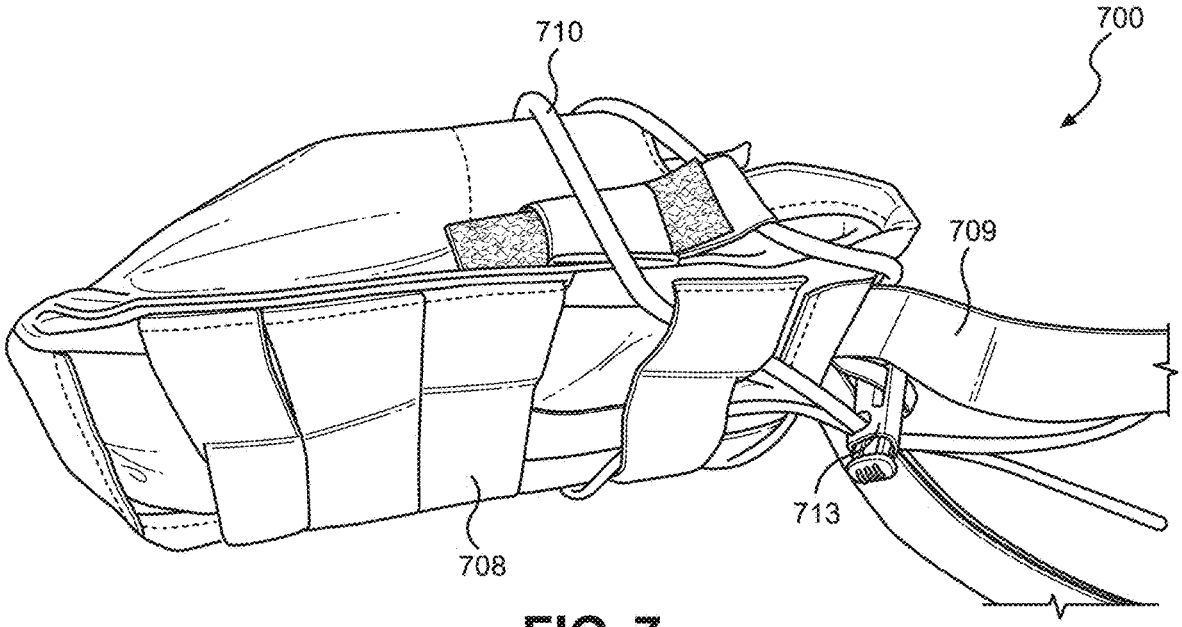
FIG. 7 shows rear perspective views of a multi-purpose pouch, according to one embodiment of the present disclosure.

FIG. 7 shows rear perspective views of a multi-purpose pouch, according to one embodiment of the present disclosure. As depicted in the figures, guide straps 708 may have multiple configurations. In the depicted configuration, there are four rows of guide straps 708. In some embodiments, there may be more than four rows of guide straps 708. In some embodiments, there may be fewer than four rows of guide straps 708. In the depicted configuration, the ends of retention element 710 are threaded through the first, uppermost row of guide straps 708 to route, position, and/or pin down the loose ends of retention element 710, which are clasped together with clasp 713. In some embodiments, the ends of retention element may be threaded in various configurations under and/or over the guide straps 708. In the depicted configuration, the first uppermost row of guide straps is followed by a space and three guide straps beneath the space.

The depicted embodiment of pouch 700 includes attachment straps 709 that are positioned substantially perpendicular to guide straps 708. In some embodiments, attachment straps 709 are used to attach pouch 700 to clothing, like a vest, pants, a bag, a belt, and other objects with suitable attachment sites. In some embodiments, attachment straps 709 may be threaded under and over guide straps 708 for various configurations to attach pouch 700 to something. In some embodiments, attachment straps 709 may be configured in various ways to accommodate various attachment sites of different sizes. For example, to attach pouch 700 to a backpack having a narrow gear loop attachment site, attachment straps may be threaded under the second, third, and/or fourth rows of guide straps. In another example, attachment straps 709 may be alternately threaded under each row of guide straps (ex: over first row, under second row, over third row, and under fourth row) to secure pouch 700 to an attachment site. In some embodiments, having alternate configurations of attachment straps 709 allow for different levels of how tightly or loosely pouch 700 is secured, attached, or hung from an attachment site. In some embodiments, alternate configurations of attachment straps 709 may allow for easier or more difficult removal of pouch 700 from an attachment site. In some embodiments, attachment straps 709 have an additional tab towards the bottom of attachment straps that may serve as a stopper, hinge, or hook that abuts against guide strap 708 so that the attachment straps 709 are secure from slipping out from underneath guide strap 708. In another example, to attach pouch 700 to a vest having a wide loop attachment site, attachment strap may be threaded under the third and/or fourth rows of guide straps 708 so as to accommodate the width of the loop attachment site on a vest.

As depicted, attachment straps 709 and guide straps 708 are made of substantially the same, flexible material. In some embodiments, attachment straps 709 and guide straps 708 are made of a flexible material, including canvas, nylon, cotton, polyester, leather, rubber, or any combination thereof. In some embodiments, having attachment straps 709 and guide straps 708 made of the same material ensures a secure attachment and easy removal from attachment site. In some embodiments, attachment straps 709 and guide straps 708 may be made of different materials. In some embodiments, attachment straps 709 may further comprise a first side of a fastener, and guide straps 708 may further comprise a second side of a fastener, and first side of fastener will engage with the second side of fastener. In some embodiments, the complementary fastener on attachment straps 709 and guide straps may be one side of a hook and loop fastener, a snap button, a magnetic closure, a hook and eye closure, a button closure, and other types of complementary fasteners or closures. Additional complementary fasteners add an additional level of secure attachment and removal of pouch 700 from an attachment site.

Figure 8:
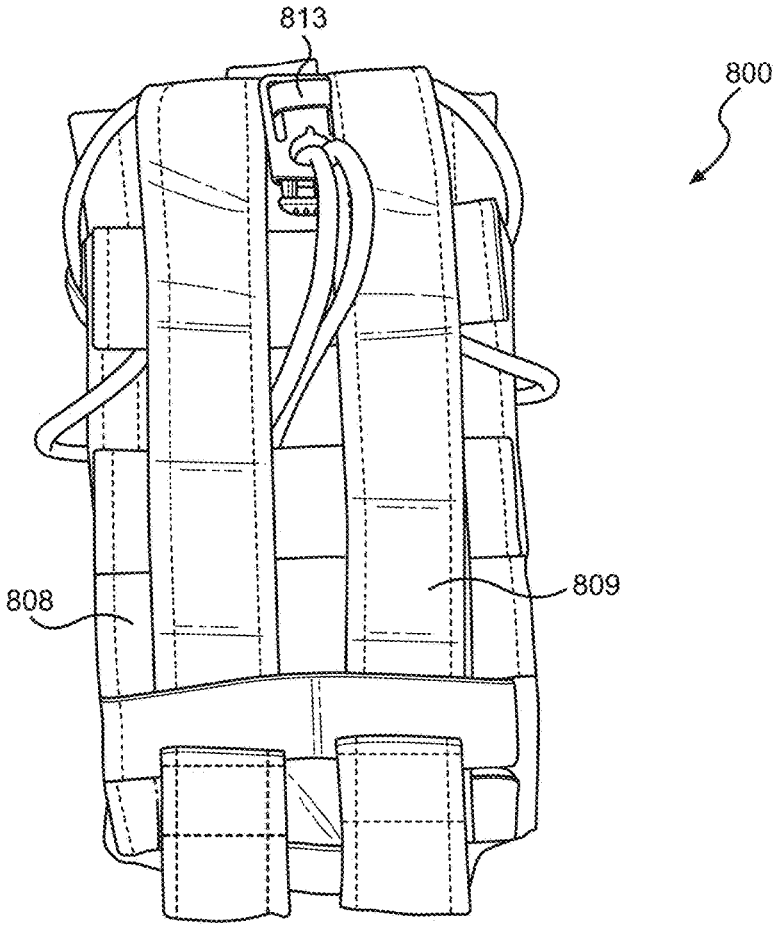
FIG. 8 shows rear view of a multi-purpose pouch, according to one embodiment of the present disclosure.
Figure 9:
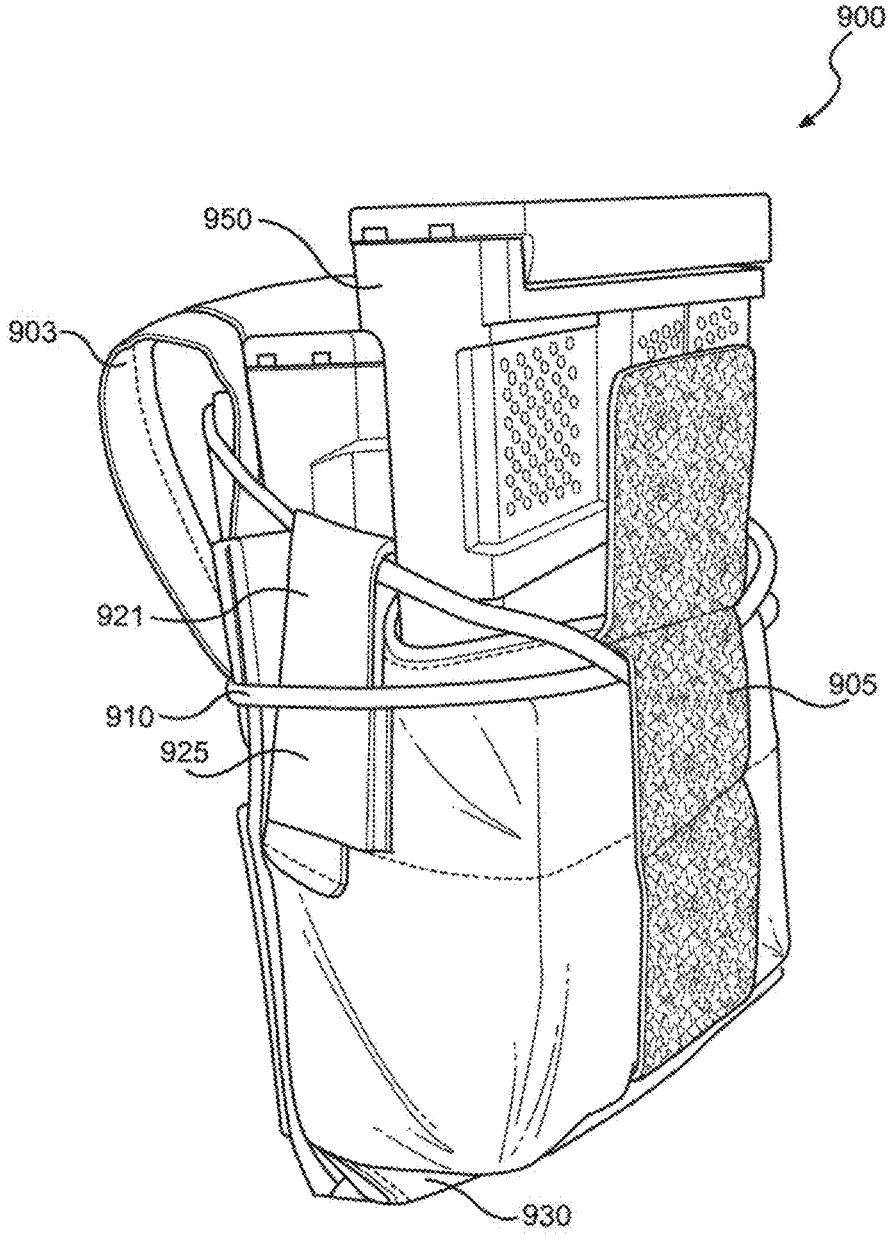
FIG. 9 shows a front angled perspective view of a multi-purpose pouch, according to another embodiment of the present disclosure.

FIG. 8 shows rear view of a multi-purpose pouch, according to one embodiment of the present disclosure. FIG. 9 shows a front angled perspective view of a multi-purpose pouch, according to another embodiment of the present disclosure. In the depicted embodiment, multi-purpose pouch 900 comprises flap 903, fastener element 905, retention element 910, securing tab 921, and side sleeve 925. In the depicted embodiment, flap 903 is folded backwards such that object 950 is exposed for easy access. In some embodiments, flap 903 is tucked into the large pocket of pouch 900. In some embodiments, flap 903 extends out and folds over such that flap 903 covers object 950 and the underside of flap 903 has a complementary fastener (not pictured) that fastens to fastener element 905. In the depicted embodiment, retention element 910 is an elastic cord that is routed and/or threaded around pouch 900. In the depicted embodiment, retention element 910 comprises securing tab 921. In the depicted embodiment, securing tab 921 is tucked into side sleeve 925.

In the depicted embodiment, base 930 of pouch 900 is located at the bottom of pouch 900. As depicted, base 930 is at substantially a 45-degree angle in relation to the back of pouch 900. In some embodiments, the angle between base 930 and the back of pouch 900 is a substantially 90-degree angle. In some embodiments, the angle between base 930 and the back of pouch 900 is less than a 90-degree angle. In some embodiments, the angle between base 930 and the back of pouch 900 is greater than a 90-degree angle. In some embodiments, the angle between base 930 and the back of pouch 900 is between a range of 15-degrees to 165-degrees. In the depicted embodiment, base 930 has been configured at a substantially 45-degree angle such that objects 950 placed into pouch 900 are also positioned or stacked in the pouch according to the angle of base 930. For example, depicted objects 950 are two rifle magazines next to each other, and due to the angled base 930 of pouch 900, the front magazine rides higher or is positioned higher than the rear magazine. In the depicted embodiment, the 45-degree angle of base 930 positions and exposes the front magazine roughly one inch higher than the rear magazine so that a user may easily grasp and extract a magazine from pouch 900, thereby giving a user shooter a purchase on the magazine. In some embodiments, objects 950 may be positioned or stacked at the same level in pouch 900. In some embodiments, where magazines are stacked at the same level in pouch 900, a user may have some difficulty and fumble while feeling around to grasp a magazine to extract from pouch 900.

In some embodiments, base 930 further comprises one or more support elements (not shown). In some embodiments, the support element is placed in the bottom of pouch 900, thereby accentuating and reinforcing the angle of base 930 in relation to back of pouch 900. In the depicted embodiment, base 930 is cut and sewn at a substantially 45-degree angle in relation to the back of pouch 900, and a thin piece of plastic (not pictured) may be placed in the bottom of pouch 900 to accentuate and reinforce the angle of base 930 in relation to the back of pouch 900. In some embodiments, the bottom of pouch 900 may further comprise one or more pockets and slots in which to insert the one or more support elements. In some embodiments, the support element may be removable or permanent. In some embodiments, the support element is made of one of metal, wood, polyethylene, cardboard, and any combination thereof.

From the above description, it is manifest that various techniques can be used for implementing the concepts described in the present application without departing from the scope of those concepts. Moreover, while the concepts have been described with specific reference to certain implementations, a person having ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A multi-purpose pouch comprising:

a pouch base, a pouch body having a first side, a second side opposite the first side, and a front, and a pouch back opposite the front, the pouch base and pouch body forming a pouch pocket, wherein a top portion of the pouch body and the pouch back define an aperture for receiving an object to be stored in the pouch pocket, wherein the pouch body includes a fastener element;

a closure flap extending from a top end of the pouch back, the closure flap comprising the complementary fastener element for engaging the fastener element when the multi-purpose pouch is in a closed configuration, and wherein the closure flap may optionally be stowed along a pouch side of the pouch back when the multi-purpose pouch is in an operational configuration; and a looped retention element having an initial end and a terminal end, the looped retention element forming a loop beginning at a retention element clasp, extending around a first side of the multi-purpose pouch and around the front of the multi-purpose pouch, through a front retention element guide, looping around a second side of the multi-purpose pouch, passing through a rear retention element guide positioned at a midpoint of the top end of the pouch side of the pouch back, continuing around the first side of the multi-purpose pouch passing through the front retention element guide in the opposite direction, continuing around the second side of the multi-purpose pouch, and passing through the retention element clasp, wherein the retention element clasp engages the initial and terminal ends of the looped retention element, wherein the retention element clasp is operable to allow a user to adjust a tension of the looped retention element by adjusting the length of the looped retention element.

2. The multi-purpose pouch of claim 1, further comprising a first securing tab and a second securing tab configured to engage the first securing tab to secure an object in the pouch pocket, the first securing tab engaged with a first securing section of the looped retention element extending between the front retention element guide and a first side of the rear retention element guide and a second securing tab engaged with a second securing section of the looped retention element extending between a second side of the rear retention element guide and the front retention element guide, the securing tabs configured to allow the user to engage the first securing tab with the second securing tab such that the looped retention element passes over an object in the pouch pocket as the looped securing element extents between the front retention element guide and the rear retention element guide.

3. The multi-purpose pouch of claim 2, wherein the securing tabs are engaged using a securing tab engagement interface.

4. The multi-purpose pouch of claim 3, wherein the securing tab engagement interface is hook-and-loop interface.

5. The multi-purpose pouch of claim 2, further comprising a first side sleeve on the first side of the multi-purpose pouch and a second side sleeve on the second side of the multi-purpose pouch, the side sleeves for stowing the securing tabs.

6. The multi-purpose pouch of claim 1, further comprising a clasp mount positioned proximate to the rear retention element guide, wherein the clasp mount secures the retention element clasp.

7. The multi-purpose pouch of claim 1, wherein the front retention element guide is a piece of webbing attached to the front of the pouch pocket creating a passage for the looping retention element and the rear retention element guide is a tube formed by a webbing attached to a top of the back of the multi-purpose pouch.

* * * * *